US010986935B2

(12) United States Patent
Thomas et al.

(10) Patent No.: US 10,986,935 B2
(45) Date of Patent: Apr. 27, 2021

(54) NON-LINEAR SPRINGS AND MATTRESSES INCLUDING THE SAME

(71) Applicant: Sealy Technology, LLC, Trinity, NC (US)

(72) Inventors: Darin T. Thomas, Salisbury, NC (US); Brian M. Manuszak, Thomasville, NC (US); Larry K. DeMoss, Greensboro, NC (US); Christina Pollock, Greensboro, NC (US); Wesley D. Ballew, Cary, NC (US); Christopher J. Kennedy, Apex, NC (US); Abed Khaskia, Clarksville, MD (US)

(73) Assignee: Sealy Technology, LLC, Trinity, NC (US)

( * ) Notice: Subject to any disclaimer, the term of this patent is extended or adjusted under 35 U.S.C. 154(b) by 0 days.

(21) Appl. No.: 16/856,564

(22) Filed: Apr. 23, 2020

(65) Prior Publication Data

US 2020/0245778 A1 Aug. 6, 2020

Related U.S. Application Data

(62) Division of application No. 15/578,942, filed as application No. PCT/US2015/034346 on Jun. 5, 2015.

(51) Int. Cl.
*A47C 27/00* (2006.01)
*A47C 27/06* (2006.01)

(52) U.S. Cl.
CPC ..... *A47C 27/064* (2013.01); *A47C 27/062* (2013.01)

(58) Field of Classification Search
CPC ..... A47C 27/063; A47C 27/06; A47C 27/064; A47C 27/045; A47C 27/053;
(Continued)

(56) References Cited

U.S. PATENT DOCUMENTS 1,434,653 A 11/1922 Fiss
1,531,547 A 3/1925 Edelson
(Continued)

FOREIGN PATENT DOCUMENTS

CH 246625 A 10/1947
EP 0910264 4/1999
(Continued)

OTHER PUBLICATIONS

European Patent Office; Extended European Search Report; dated Jan. 4, 2019, 18 pgs.
(Continued)

*Primary Examiner* — Peter M. Cuomo
*Assistant Examiner* — Ifeolu A Adeboyejo
(74) *Attorney, Agent, or Firm* — Middleton Reutlinger

(57) ABSTRACT

A pocketed spring, such as that used in a mattress, comprises: a compression spring having an upper end convolution and a lower end convolution opposite the upper end convolution, and a plurality of helical intermediate convolutions between the upper end convolution and the lower end convolution; a flexible enclosure including a top wall positioned adjacent to the upper end convolution of the compression spring, a bottom wall positioned adjacent to the lower end convolution of the compression spring, and a side wall that extends from the top wall to the bottom wall; and a tension member connected to the flexible enclosure. The tension member acts in opposition to the compression spring until the pocketed spring is compressed to a point at which the tension member no longer applies any force. Thus, the pocketed spring exhibits a non-linear response when compressed.

4 Claims, 10 Drawing Sheets

(58) Field of Classification Search
CPC ... A47C 27/067; A47C 27/07; A47C 27/0456; A47C 27/008; A47C 27/00
See application file for complete search history.

(56) References Cited

U.S. PATENT DOCUMENTS

| | | | | |
|---|---|---|---|---|
| 1,804,821 | A | 5/1931 | Stackhouse | |
| 3,031,690 | A | 5/1962 | Ramsay | |
| 3,608,107 | A | 9/1971 | Kentor | |
| 3,833,952 | A | 9/1974 | Rosenberg | |
| 4,439,977 | A | 4/1984 | Stumpf | |
| 4,578,834 | A * | 4/1986 | Stumpf | A47C 27/064 156/291 |
| 4,609,186 | A | 9/1986 | Thoenen | |
| 5,467,489 | A | 11/1995 | Cchen | |
| 5,924,681 | A * | 7/1999 | Bullard | A47C 27/063 267/89 |
| 6,260,223 | B1 | 7/2001 | Mossbeck et al. | |
| 6,948,205 | B2 * | 9/2005 | Van Der Wurf | A47C 27/144 5/718 |
| 6,966,091 | B2 * | 11/2005 | Barber | A47C 27/062 267/89 |
| 7,185,379 | B2 | 3/2007 | Barman | |
| 7,640,611 | B1 * | 1/2010 | Kluft | A47C 23/30 5/716 |
| 7,805,790 | B2 | 10/2010 | DeMoss | |
| 7,908,693 | B2 | 3/2011 | DeMoss | |
| 8,176,589 | B2 * | 5/2012 | Stjerna | A47C 27/064 5/720 |
| 8,714,531 | B2 * | 5/2014 | Roma | A47C 23/0438 267/220 |
| 8,895,109 | B2 | 11/2014 | Cohen | |
| 9,060,616 | B2 | 6/2015 | Cohen | |
| 9,332,856 | B2 * | 5/2016 | Eigenmann | A47C 27/064 |
| 9,386,861 | B2 * | 7/2016 | Roma | A47C 23/0438 |
| 10,076,193 | B2 * | 9/2018 | Long | B29C 66/21 |
| 2002/0152554 | A1 | 10/2002 | Spinks | |
| 2004/0133988 | A1 | 7/2004 | Barber | |
| 2004/0231057 | A1 | 11/2004 | Sabin | |
| 2007/0289068 | A1 | 12/2007 | Edling | |
| 2010/0139006 | A1 | 6/2010 | Kilic | |
| 2010/0227091 | A1 | 9/2010 | Pearce | |
| 2010/0257675 | A1 | 10/2010 | DeMoss | |
| 2012/0096649 | A1 | 4/2012 | Fukano | |
| 2013/0069291 | A1 | 3/2013 | Roma | |
| 2014/0191454 | A1 * | 7/2014 | Roma | A47C 23/30 267/143 |
| 2016/0029809 | A1 | 2/2016 | Shive | |
| 2016/0073789 | A1 * | 3/2016 | Hyltenfeldt | A47C 27/064 5/720 |
| 2017/0035211 | A1 | 2/2017 | Alletto | |
| 2017/0354267 | A1 * | 12/2017 | Alletto, Jr. | A47C 27/0453 |
| 2018/0153310 | A1 | 6/2018 | Thomas | |
| 2018/0168360 | A1 | 6/2018 | Thomas et al. | |
| 2018/0192781 | A1 | 7/2018 | Hyltenfeldt | |

FOREIGN PATENT DOCUMENTS

| | | | |
|---|---|---|---|
| EP | 2433522 | | 3/2012 |
| FR | 2799622 | A1 | 4/2001 |
| GB | 586757 | | 3/1947 |
| KR | 20140120104 | A | 10/2014 |
| WO | 20120155132 | A1 | 11/2012 |

OTHER PUBLICATIONS

New Zealand Intellectual Property Office, Further Examination Report for Case No. 737804 dated Feb. 28, 2019.
Patent Cooperation Treaty, International Search Report and Written Opinion, dated Feb. 23, 2016, 13 pages.

* cited by examiner

NON-LINEAR SPRINGS AND MATTRESSES INCLUDING THE SAME

CLAIM TO PRIORITY

This divisional patent application claims priority to and benefit of, under 35 U.S.C. § 121, U.S. patent application Ser. No. 15/578,942, filed Dec. 1, 2017 and titled "Non-Linear Springs and Mattresses Including the Same", which claims priority to PCT/US2015/034346, filed Jun. 5, 2015 and titled "Non-Linear Springs and Mattresses Including the Same", all of which is incorporated by reference herein.

TECHNICAL FIELD

The present invention relates to springs and mattresses including springs. In particular, the present invention relates to pocketed springs which exhibit a non-linear response when compressed.

BACKGROUND

Typically, when a uniaxial load is applied to a spring, the spring exhibits a linear compression rate. That is to say, it takes twice as much force to compress a typical spring two inches as it does to compress the same spring one inch. The linear response of springs is expressed by Hooke's law which states the force (F) needed to extend or compress a spring by some distance (D) is proportional to that distance. This relationship is expressed mathematically as F=kD, where k represents the spring constant for a particular spring. A high spring constant indicates that the spring requires more force to compress, and a low spring constant means the spring requires less force to compress.

Spring rate is another well-known value used to categorize springs. The spring rate of a particular spring is the amount of force needed to compress a spring one inch. Springs with a high spring constant also have high spring rates, and springs with low spring constants have low spring rates. Of course, the spring constant and spring rate values are merely an approximation of the real response of a given spring; however, they are accurate approximations for most springs given reasonable distance (D) values in comparison to the overall dimensions of the spring. Furthermore, Hooke's law applies for a variety of different spring shapes, including, for example, a coil spring, a cantilever spring, a leaf spring, or even a rubber band.

Linear response springs, such as wire coil springs, are commonly used as mattress innersprings in combination with padding and upholstery that surround the innersprings. Most mattress innersprings are comprised of an array of wire coil springs which are often adjoined by lacing end convolutions of the coil springs together with cross wires. An advantage of this arrangement is that it is inexpensive to manufacture. However, this type of innerspring provides a firm and rigid mattress surface.

Another type of spring that has been used in mattress construction is the pocketed spring. A pocketed spring is a compression spring enclosed in a flexible fabric cover. The pocketed springs are sewn together to form a cohesive unit. This provides a more comfortable mattress surface because the springs become relatively individually flexible, so that each spring may flex separately without affecting the neighboring springs. In many pocketed spring mattresses, the spring is pre-compressed in the cloth cover so that the spring will provide a level of support before experiencing any deflection. Only after the pre-load value is exceeded does the spring begin to deflect, at which point the spring behaves as a linear response spring.

An alternative to an innerspring mattress is a mattress constructed of one or more foam layers. Unlike an innerspring comprised of an array of wire coil springs, foam mattresses exhibit a non-linear response to forces applied to the mattress. In particular, a foam mattress provides more support as the load increases. For instance, a typical foam mattress provides increased support after it has been compressed approximately 60% of the maximum compression of the foam. The non-linear response of foam mattresses provides improved sleep comfort for a user. However, the mechanical properties of foam degrade over time affecting the overall comfort of the foam mattress. Furthermore, foam mattresses are more costly than metal spring mattresses.

SUMMARY

The present invention relates to springs that provide variable resistance as the spring is compressed. In particular, the present invention relates to pocketed springs that include a tension member which works in opposition to the pocketed compression spring for a first portion of the spring's compression. Such pocketed springs are used within a mattress to provide a user positioned on the mattress increased support for portions of the user's body where a higher load is applied to the mattress. Thus, a mattress incorporating such pocketed springs provides a user the non-linear support typically seen in a foam mattress, but through the use of pocketed springs.

In one exemplary embodiment of the present invention, a pocketed spring for use in a mattress is provided that includes a compression spring made of a continuous wire and having an upper end convolution, a lower end convolution opposite the upper end convolution and a plurality of intermediate convolutions which helically spiral between the upper end convolution and the lower end convolution. The upper end convolution of the compression spring ends in a circular loop at the extreme upper end of the compression spring, and the lower end convolution is similarly formed with a circular loop at the extreme lower end of the compression spring. The upper and lower end convolutions each terminate in a generally planar form which serve as the supporting end structures of the compression spring. The exemplary pocketed spring further includes a flexible enclosure that contains the compression spring with a top wall positioned adjacent to the upper end convolution of the compression spring, a bottom wall positioned adjacent to the lower end convolution, and a continuous side wall that extends between the top wall and the bottom wall. The flexible enclosure is preferably made of a non-woven fabric that exhibits a desired amount of stretch at least along the longitudinal (or vertical) axis of the pocketed spring.

In one exemplary embodiment, the pocketed spring also includes a tension member that is made of an elastomer and is laminated to a portion of the side wall of the flexible enclosure. In particular, the tension member is in the form of a cylindrical band that is laminated to a mid-section of the side wall of the flexible enclosure; however, it is contemplated that the tension member could be laminated to substantially all of the side wall of the flexible enclosure. It is also contemplated that the portion of the side wall of the flexible enclosure to which the tension member is laminated is made from a material that is capable of a similar amount of elongation as the tension member, at least along the longitudinal (or vertical) axis of the pocketed spring. In this way, both the tension member and the underlying portion of the flexible enclosure are capable of stretching; however the tension member is further capable of providing a much greater tensile force than the material comprising the underlying portion of the flexible enclosure.

According to the present invention, when the compression spring is "pocketed" or placed into the flexible enclosure, the compression spring is held in a pre-compressed state by the flexible enclosure, while the tension member is in a stretched or tension state. With the compression spring pre-compressed within the flexible enclosure and the tension member acting in tension, the resting state of the pocket spring thus represents an equilibrium between the compression spring and the tension member. In this regard, when a force is subsequently applied to the pocketed spring, the "pre-load" typically observed with pocketed springs is negated or eliminated, and the initial state or equilibrium observed in the pocketed spring transitions to a first response state where lesser amounts of tension develop in the tension member and there is more compression observed in the compression spring. Subsequently, as more force is applied to the pocketed spring, it is compressed to a point where the tension member is in a relaxed state and only the compression spring is acting against the force being applied to the pocketed spring. In this way, the pocketed spring of the present invention thus exhibits two different response states when force is applied, namely: a first response state, where both the compression spring and the tension member are engaged and the spring constant of the pocketed spring is the spring constant of the compression spring less the spring constant of the tension member; and a second response state, where only the compression spring is engaged and the spring constant of the pocketed spring is the spring constant of the compression spring. Accordingly, by connecting the tension member to the flexible enclosure, the pocketed spring of the present invention exhibits a non-linear response to loading and preferred compression responses of the pocketed spring can be developed.

In another exemplary embodiment of the present invention, a pocketed spring is provided that also includes a compression spring and a flexible enclosure similar to the pocketed spring described above but wherein the side wall of the flexible enclosure is made entirely of an elastic fabric such that the flexible enclosure itself serves as a tension member. As an additional refinement of the spring, the sidewall of the flexible enclosure could be comprised of more than one section with only one selected section of the side wall being made of an elastic fabric, while the remaining sections are made of an inelastic fabric. In this way, the amount of the flexible enclosure comprising the elastic fabric can be adjusted to provide a desired tensile force and develop a preferred compression response of the pocketed spring.

In another exemplary embodiment of the present invention, a pocketed spring is provided that also includes a compression spring and a flexible enclosure similar to the pocketed spring described above, but wherein the tension member is made of an elastomer and is laminated to an interior surface of a mid-section of the side wall of the flexible enclosure. Further, in this exemplary embodiment, the entire flexible enclosure is made of an inelastic material. To this end, in order to allow the tension member to reach the stretch state, the tension member is in a pre-tensioned state when it is laminated to the side wall of the flexible enclosure, such that, as the pocketed spring compresses and the tension member partially relaxes, the underlying inelastic material of the flexible enclosure begins to bunch or crimp outward. Advantageously, by having the entire flexible enclosure comprised of an non-woven material, the flexible enclosure prevents the tension member from stretching past the pre-tensioned state, which is contemplated to help prevent any creep in the tension member while it is under tension. It is also contemplated that the tension member may be laminated to substantially all of the interior of the side wall of the flexible enclosure instead of merely a mid-section.

In another exemplary embodiment of the present invention, a pocketed spring is provided that also includes a compression spring and a flexible enclosure similar to the pocketed spring described above, but wherein the tension member in the form of an elastic cable that is connected to the top wall of the flexible enclosure and the bottom wall of the flexible enclosure such that the elastic cable extends through the interior of the flexible enclosure along a central longitudinal axis of the compression spring. The elastic cable is configured such that it will enter a relaxed state prior to the compression spring reaching a maximum compression such that the pocketed spring exhibits a nonlinear response to force loading similar to the alternate embodiments described above. It is contemplated that the elastic cable could be comprised of one or more elastic strands aligned linearly or braided into a single cord. Additionally, the elastic cable may further include a cover made of a woven textile which surrounds a core of elastic strands.

As an alternative to a tension member in the form of an elastic cable, the spring may also include a tension member in the form of an inner spring that is connected to the top wall of the flexible enclosure and the bottom wall of the flexible enclosure such that the inner spring extends through the interior of the flexible enclosure along a central longitudinal axis of the compression spring. It is contemplated that as the pocketed spring compresses, the inner spring transitions from a tensile state into a compressive state wherein it exerts a compressive force that acts in addition to the compressive force of the compression spring. However, it is also contemplated that in some embodiments, the inner spring would be configured to buckle rather than transitioning into a compressive state. In these embodiments, the inner spring does not exert any appreciable compressive force.

Further, in other exemplary embodiments of the present invention, a pocketed spring is provided that includes a coil-in-coil spring having an outside coil and an inside coil that are coaxial, helical-formed springs made of a continuous wire which may be used in combination with the various flexible enclosures and tension members described above. The outside coil of the coil-in-coil spring begins with a flat base that continues upward in a spiral section to form the body of the spring. An upper end convolution of the outside coil ends in a circular loop at the extreme end of the coil-in-coil spring. The base is formed with a double circular loop with the inside loop extending upward in a spiral to form the inside coil. The outside coil is larger in height than the inside coil. Also, the diameter of the outside coil is larger than the diameter of the inside coil, which ensures there is no interference between the outside and inside coils. During initial loading, only the outside coil is compressed whereas under a heavy or concentrated load, both the outside and inside coils work to support the load.

Accordingly, such a pocketed coil-in-coil spring also exhibits a non-linear response to force loading, and in particular, the pocketed spring of this particular embodiment, which makes use of a coil-in-coil spring arrangement and a tension member, exhibits three different response states as opposed to the two response states of the springs described above. In a first response state, the outside coil of the coil-in-coil spring and the tension member are engaged and the spring constant of the pocketed spring is the spring constant of the outside coil of the coil-in-coil spring less the spring constant of the tension member. Then, in the second response state, the tension member is in a relaxed state and only the outside coil of the coil-in-coil spring is engaged, such that the spring constant of the pocketed spring is the spring constant of the outside coil of the coil-in-coil spring. Finally, in the third response state, both the outside and inside coils of the coil-in-coil spring are engaged and the spring constant of the pocketed spring is the spring constant of the outside coil plus the spring constant of the inside coil of the coil-in-coil spring.

In still further embodiments of the present invention, a mattress is also provided that includes a plurality of the pocketed springs described above arranged in a matrix such that the top walls of the flexible enclosures of the pocketed springs collectively define a first support surface (or sleep surface) and the bottom walls of the flexible enclosures of the pocketed springs define a second support surface opposite the first support surface. The mattress also comprises an upper body supporting layer positioned adjacent to the first support surface, along with a lower foundation layer positioned adjacent to the second support surface. Furthermore, a side panel extends between the upper body supporting layer and the lower foundation layer around the entire periphery of the two layers, such that the pocketed springs are completely surrounded.

Further features and advantages of the present invention will become evident to those of ordinary skill in the art after a study of the description, figures, and non-limiting examples in this document.

DESCRIPTION OF EXEMPLARY EMBODIMENTS

Figure 1:
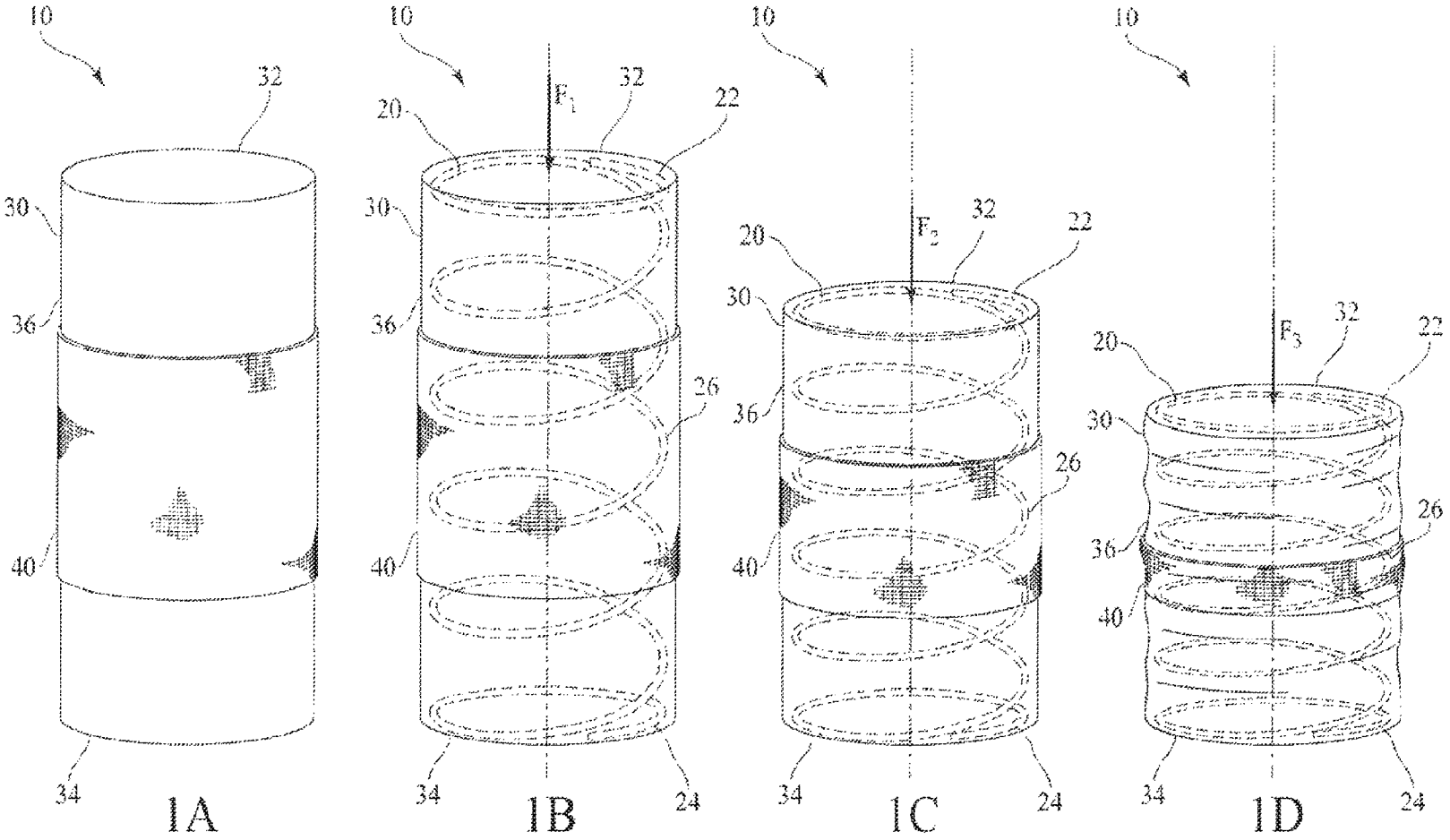
FIG. 1A is a perspective view of an exemplary pocketed spring made in accordance with the present invention.
FIG. 1B is a perspective view of the exemplary pocketed spring of FIG. 1A, with a first predetermined force, $F_1$, applied to the pocketed spring.
FIG. 1C is a perspective view of the exemplary pocketed spring of FIG. 1A, with a second predetermined force, $F_2$, applied to the pocketed spring, such that the pocketed spring is partially compressed.
FIG. 1D is a perspective view of the exemplary pocketed spring of FIG. 1A, with a third predetermined force, $F_3$, applied to the pocketed spring, such that the pocketed spring is further compressed.
Figure 2:
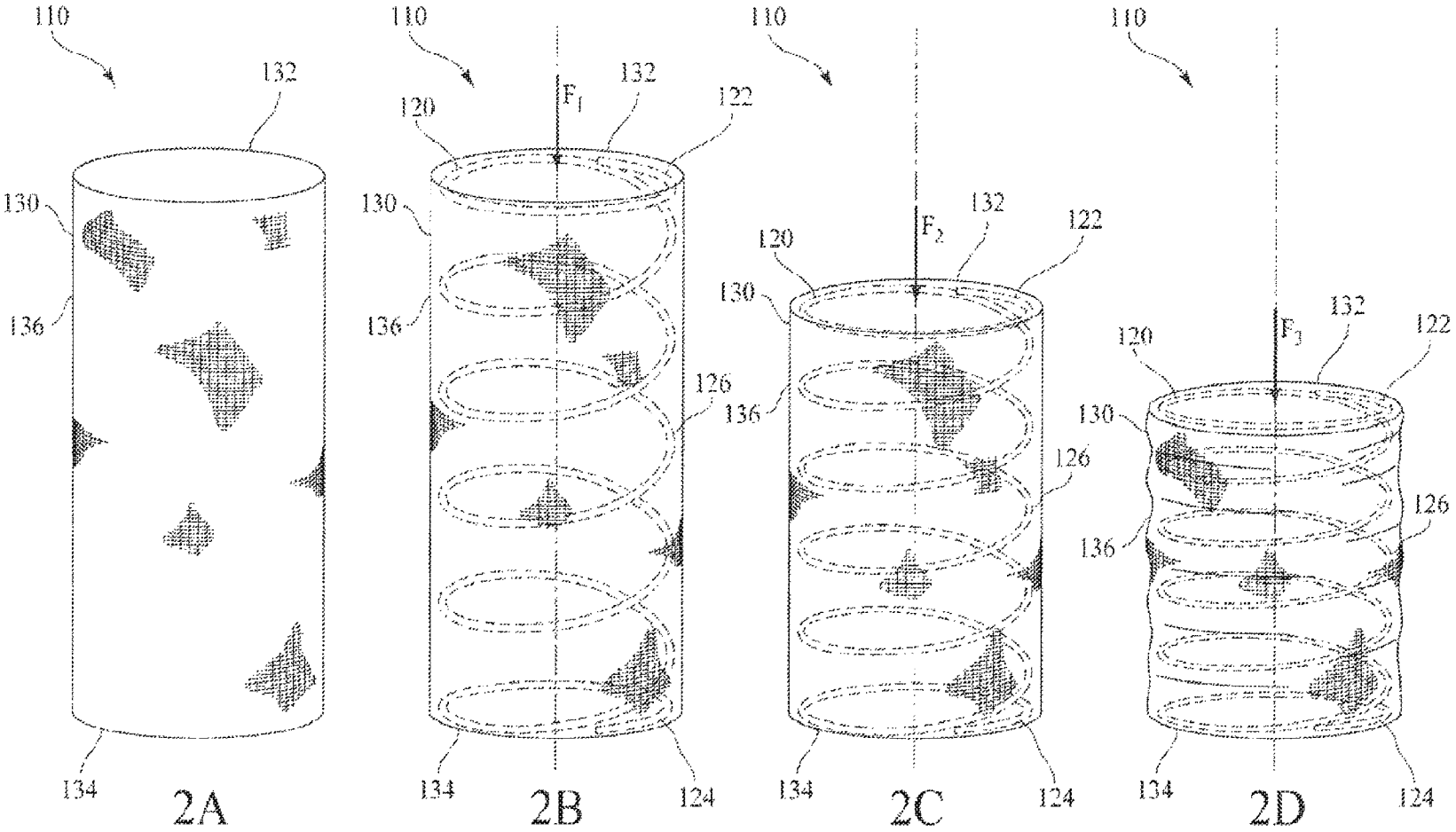
FIG. 2A is a perspective view of another exemplary pocketed spring made in accordance with the present invention.
FIG. 2B is a perspective view of the exemplary pocketed spring of FIG. 2A, with a first predetermined force, $F_1$, applied to the pocketed spring.
FIG. 2C is a perspective view of the exemplary pocketed spring of FIG. 2A, with a second predetermined force, $F_2$, applied to the pocketed spring, such that the pocketed spring is partially compressed.
FIG. 2D is a perspective view of the exemplary pocketed spring of FIG. 2A, with a third predetermined force, $F_3$, applied to the pocketed spring, such that the pocketed spring is further compressed.

The present invention relates to springs that provide variable resistance as the spring is compressed. In particular, the present invention relates to pocketed springs that include a tension member which works in opposition to the pocketed compression spring for a first portion of the spring's compression. Such pocketed springs are used within a mattress to provide a user positioned on the mattress increased support for portions of the user's body where a higher load is applied to the mattress. Thus, a mattress incorporating such pocketed springs provides a user the non-linear support typically seen in a foam mattress, but through the use of pocketed springs.

Referring first to FIGS. 1A-D, in one exemplary embodiment of the present invention, a pocketed spring 10 for use in a mattress includes a compression spring 20 made of a continuous wire and having an upper end convolution 22, a lower end convolution 24 opposite the upper end convolution 22, and a plurality of intermediate convolutions 26 which helically spiral between the upper end convolution 22 and the lower end convolution 24. The upper end convolution 22 of the compression spring 20 ends in a circular loop at the extreme upper end of the compression spring 20. The lower end convolution 24 is similarly formed with a circular loop at the extreme lower end of the compression spring 20. The upper and lower end convolutions 22, 24 each terminate in a generally planar form, which serve as the supporting end structures of the compression spring 20.

In the exemplary embodiment shown in FIGS. 1A-D, there are four intermediate convolutions 26, such that the compression spring 20 is made of a total of six convolutions or turns. Of course, various other springs, having, for example, different numbers of convolutions or alternate dimensions, could also be used without departing from the spirit and scope of the present invention.

Referring still to FIGS. 1A-D, the exemplary pocketed spring 10 further includes a flexible enclosure 30 that contains the compression spring 20. The flexible enclosure 30 has a generally cylindrical construction, including a top wall 32 positioned adjacent to the upper end convolution 22 of the compression spring 20, a bottom wall 34 positioned adjacent to the lower end convolution 24 of the compression spring 20, and a continuous side wall 36 that extends between the top wall 32 and the bottom wall 34. The flexible enclosure 30 is preferably made of a non-woven fabric which can joined or welded together by heat and pressure (e.g., via ultrasonic welding or similar thermal welding procedure). For example, suitable fabrics may include one of various thermoplastic fibers known in the art, such as non-woven polymer-based fabric, non-woven polypropylene material, or non-woven polyester material. In this regard, in some embodiments, suitable non-woven fabrics can be comprised of an elastic material, such as an elastane (i.e., spandex), that is capable of recovering to its original shape upon stretching. In short, a wide variety of fabrics or similar material can thus be used to make a flexible enclosure in accordance with the present invention and, of course, such non-woven fabrics can be joined together by stitching, metal staples, or other suitable methods. However, in selecting a particular non-woven fabric for a flexible closure, the non-woven fabric will typically be selected such that it provides and/or exhibits a desired amount of stretch along the longitudinal (or vertical) axis of the pocketed spring 10.

Referring still to FIGS. 1A-1D, the exemplary pocketed spring 10 also includes a tension member 40 that is made of an elastomer and is laminated to a portion of the side wall 36 of the flexible enclosure 30. Specifically, in this exemplary embodiment, the tension member 40 is in the form of a cylindrical band that is laminated to a mid-section of the side wall 36 of the flexible enclosure 30; however, it is contemplated that the tension member 40 could be laminated to substantially all of the side wall 36 of the flexible enclosure 30.

Irrespective of the particular configuration of the tension member 40, because the tension member 40 is an elastomer, it exhibits a high degree of recoverable elongation with little to no creep while under tension. For example, the elastomer may be a latex, a neoprene, or some other highly cross-linked polymer. In order to facilitate the elongation of the tension member 40, it is also contemplated that the portion of the side wall 36 of the flexible enclosure 30 to which the tension member 40 is laminated could be made from a material (e.g., an elastic textile or a flexible non-woven fabric) that is capable of a similar amount of elongation as the tension member 40, at least along the longitudinal (or vertical) axis of the pocketed spring 10, with the remainder of the flexible enclosure 30 made of an inelastic fabric as described above. In this way, both the tension member 40 and the underlying portion of the flexible enclosure 30 are capable of stretching; however, the tension member 40 is further capable of providing a much greater tensile force than the material comprising the underlying portion of the flexible enclosure 30.

Referring now to FIG. 1A-D, when the compression spring 20 is "pocketed" or placed into the flexible enclosure 30, the compression spring 20 is held in a pre-compressed state by the flexible enclosure 30, while the tension member 40 is in a stretched state. With the compression spring 20 pre-compressed within the flexible enclosure 30 and the tension member 40 under tension, the resting state of the pocketed spring 10 thus represents an equilibrium between the forces being exerted by the compression spring 20 and the tension member 40, which is shown in FIG. 1A. As shown in FIG. 1B, however, when a first force, $F_1$, is applied to the pocketed spring 10, that equilibrium transitions to a state where the tension member 40 is under a lesser amount of tension and the compression spring 20 is acting against both the first predetermined force, $F_1$, as well as the lessening tensile force from the tension member 40. As a further amount of force, $F_2$, is then applied to the pocketed spring 10, the pocketed spring 10 continues to compress with the tension member 40 under continually lessening amounts of tension, but still providing a tensile force on the compression spring 20 that is undergoing further compression. Subsequently and as shown in FIG. 1D, as even an further force, $F_3$, is applied to the pocketed spring 10 that exceeds the second predetermined force, $F_2$, the pocketed spring 10 compresses to a point where the tension member 40 is in a relaxed state and under no tension, and only the compression spring 20 is acting against the third predetermined force, $F_3$. In other words, the tension member 40 is configured such that it will enter a relaxed state prior to the compression spring 20 reaching a maximum compression.

Figure 6:
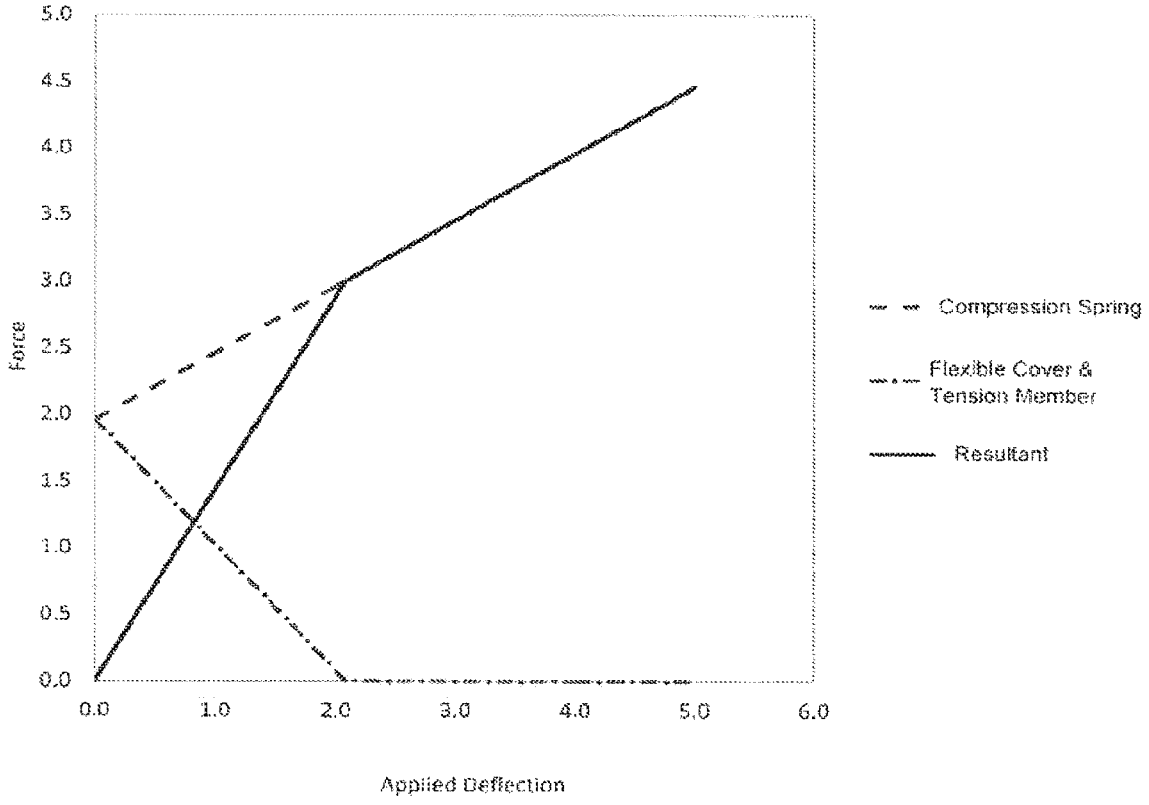
FIG. 6 is a graph showing the deflection of the exemplary pocketed spring of FIGS. 1A-D as a function of force applied to the exemplary pocketed spring.

Referring now to FIG. 6, FIG. 6 graphically depicts the deflection of the exemplary pocketed spring 10 as increasing force is applied to the pocketed spring 10, and illustrates that the pocketed spring 10 exhibits a non-linear response to force loading. In particular, the pocketed spring 10 exhibits two different response states as the "pre-load" that is typically observed with pocketed springs is negated or eliminated by the equilibrium that exists between the forces present due to the pre-compression of the compression spring 20 within the flexible enclosure 30 and due to the tension member 40 being under tension, as shown by dashed lines in FIG. 6. In this regard, when a force is subsequently applied to the pocketed spring 10, the pocketed spring transitions directly from the equilibrium state to the first response state. As shown in FIG. 6, the initial solid line extending from the origin of the graph represents the first response state of the pocketed spring 10, where both the compression spring 20 and the tension member 40 are engaged, and where the spring constant of the pocketed spring 10 is a combination of the spring constants of the compression spring 20 and the tension member 40. In particular, the spring constant of the pocketed spring 10 in the first response state is the spring constant of the compression spring 20 less the spring constant of the tension member 40. As more force is then applied to the pocketed spring 10, the pocketed spring 10 transitions to a second response state that is shown by the solid line having a smaller slope in FIG. 6. In the second response state, only the compression spring 20 is engaged, and the spring constant of the pocketed spring 10 is the spring constant of the compression spring 20. Accordingly, by connecting the tension member 40 to the flexible enclosure 30, the pocketed spring 10 of the present invention exhibits a non-linear response to loading. In this regard, the exemplary pocketed springs of the present thus further allow various non-linear compression responses to be developed as desired by changing the configuration or types of tension members and coils used in the exemplary pocketed springs, as described in further detail below.

Referring now to FIGS. 2A-D, in another exemplary embodiment of the present invention, a pocketed spring 110 is provided that also includes: (i) a compression spring 120 made of a continuous wire and having an upper end convolution 122, a lower end convolution 124 opposite the upper end convolution 122, and a plurality of intermediate convolutions 126 between the upper end convolution 122 and the lower end convolution 124; and (ii) a flexible enclosure 130 that includes a top wall 132 positioned adjacent to the upper end convolution 122 of the compression spring 120, a bottom wall 134 positioned adjacent to the lower end convolution 124 of the compression spring 120, and a side wall 136 that extends between the top wall 132 and the bottom wall 134. Thus, the pocketed spring 110 has a construction similar to the pocketed spring 10 described above with reference to FIGS. 1A-D. However, in this exemplary pocketed spring 110, the side wall 136 of the flexible enclosure 130 is made entirely of an elastic fabric such that the flexible enclosure 130 itself serves as a tension member (i.e., replaces the tension member 40 as compared to the pocketed spring 10 described above with reference to FIGS. 1A-D).

Although not shown, in other contemplated embodiments, the side wall 136 of the flexible enclosure 130 of the pocketed spring 110 could be comprised of more than one section, with only one selected section of the side wall 136 being made of an elastic fabric, while the remaining sections are made of a fabric having lesser elasticity. In this way, the amount of the flexible enclosure 130 comprising the elastic fabric can be adjusted to provide a desired tensile force and develop a preferred compression response of the pocketed spring 110.

Regardless of the particular configuration of the flexible enclosure 130, the pocketed spring 110 exhibits a non-linear response to force loading similar to the pocketed spring 10 described above with reference to FIGS. 1A-D and 6. Specifically, in a first response state, both the compression spring 120 and the flexible enclosure 130 (serving as a tension member) are engaged, and the spring constant of the pocketed spring 110 is the spring constant of the compression spring 120 less the spring constant of the flexible enclosure 130. In a second response state, only the compression spring 120 is engaged, and the spring constant of the pocketed spring 110 is the spring constant of the compression spring 120.

Referring now to FIGS. 3A-D, in another exemplary embodiment of the present invention, a pocketed spring 210 is provided that also includes: (i) a compression spring 220 made of a continuous wire and having an upper end convolution 222, a lower end convolution 224 opposite the upper end convolution 222, and a plurality of intermediate convolutions 226 between the upper end convolution 222 and the lower end convolution 224; and (ii) a flexible enclosure 230 that includes a top wall 232 positioned adjacent to the upper end convolution 222 of the compression spring 220, a bottom wall 234 positioned adjacent to the lower end convolution 224, and a side wall 236 that extends between the top wall 232 and the bottom wall 234. Thus, the pocketed spring 210 has a construction similar to the pocketed spring 10 described above with reference to FIGS. 1A-D.

The pocketed spring 210 also includes a tension member (not shown) that is made of an elastomer and is laminated to an interior surface of a mid-section of the side wall 236 of the flexible enclosure 230. In this regard, the tension member would be substantially similar to the tension member 40 described above with reference to FIGS. 1A-D, but laminated to an interior surface, rather than an exterior surface, of the side wall 236.

Figure 3:
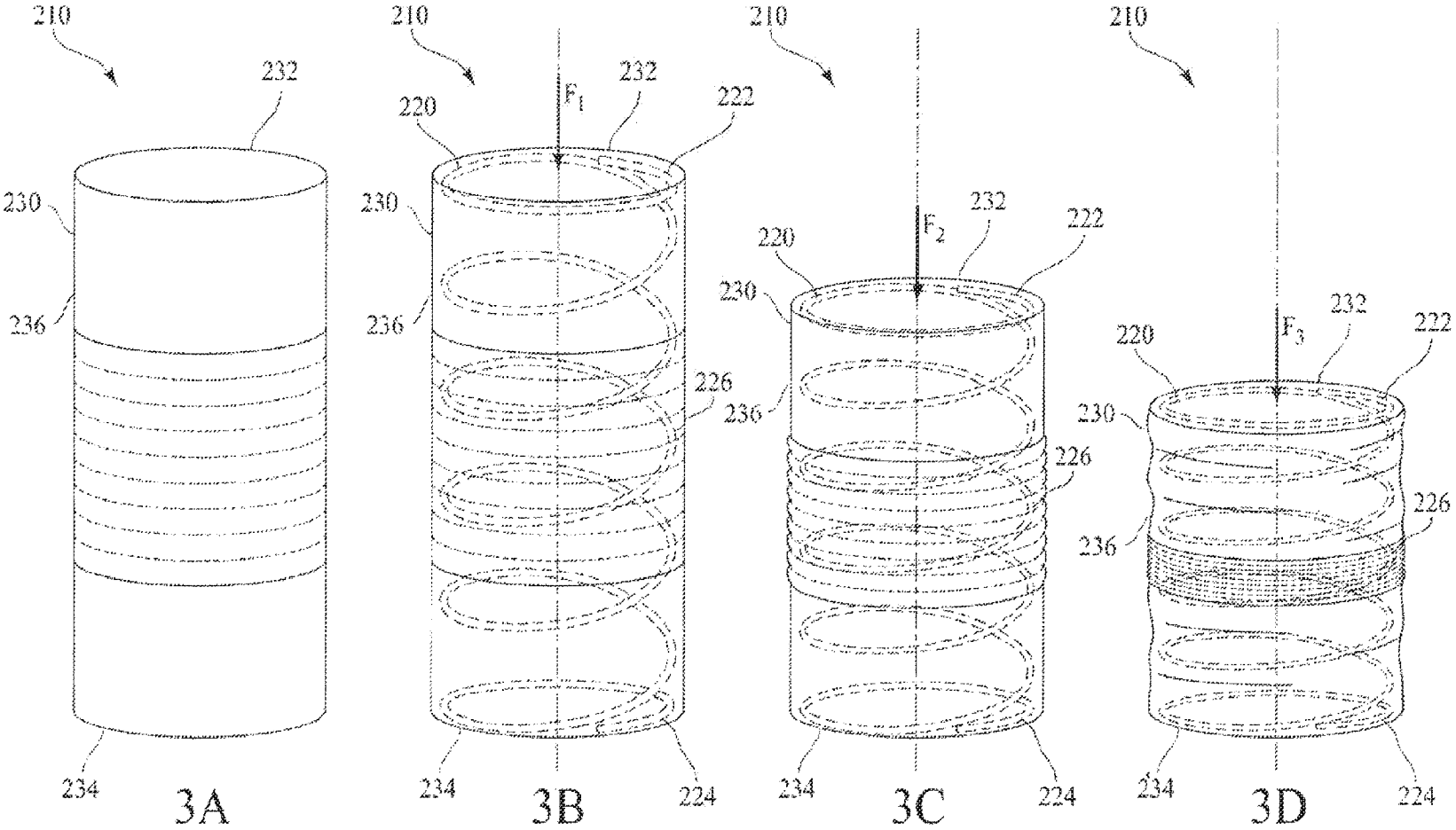
FIG. 3A is a perspective view of another exemplary pocketed spring made in accordance with the present invention.
FIG. 3B is a perspective view of the exemplary pocketed spring of FIG. 3A, with a first predetermined force, $F_1$, applied to the pocketed spring.
FIG. 3C is a perspective view of the exemplary pocketed spring of FIG. 3A, with a second predetermined force, $F_2$, applied to the pocketed spring, such that the pocketed spring is further compressed.
FIG. 3D is a perspective view of the exemplary pocketed spring of FIG. 3A, with a third predetermined force, $F_3$, applied to the pocketed spring, such that the pocketed spring is further compressed.

Unlike the pocketed spring 10 described above with reference to FIGS. 1A-D, in this exemplary embodiment, the entire flexible enclosure 230 is made of an inelastic material. To this end, in order to allow the tension member to reach the stretched state shown in FIG. 3A, the tension member is in a pre-tensioned state when it is laminated to the side wall 236 of the flexible enclosure 230. As shown in FIGS. 3C and 3D, as the pocketed spring 210 compresses and the tension member partially relaxes, the underlying inelastic material of the side wall 236 of the flexible enclosure 230 begins to bunch or crimp. Advantageously, by having the entire flexible enclosure 230 made of an inelastic material, the flexible enclosure 230 prevents the tension member from stretching past the pre-tensioned state shown in FIG. 3A, which helps prevent any creep in the tension member while it is under tension.

Similar to the tension member 40 described above with reference to FIGS. 1A-D, it is also contemplated that the tension member in the pocketed spring 210 could be laminated to substantially all of the side wall 236 of the flexible enclosure 230, instead of just the mid-section.

Regardless of the particular configuration of the tension member, the pocketed spring 210 also exhibits a non-linear response to force loading similar to the pocketed spring 10 described above with reference to FIGS. 1A-D and 6. Specifically, in a first response state, both the compression spring 220 and the tension member are engaged, and the spring constant of the pocketed spring 210 is the spring constant of the compression spring 220 less the spring constant of the tension member 240. In a second response state, only the compression spring 220 is engaged, and the spring constant of the pocketed spring 210 is the spring constant of the compression spring 220.

Referring now to FIGS. 4A-D, in another exemplary embodiment of the present invention, a pocketed spring 310 is provided that also includes: (i) a compression spring 320 made of a continuous wire and having an upper end convolution 322, a lower end convolution 324 opposite the upper end convolution 322, and a plurality of intermediate convolutions 326 between the upper end convolution 322 and the lower end convolution 324; and (ii) a flexible enclosure 330 that includes a top wall 332 positioned adjacent to the upper end convolution 322 of the compression spring 320, a bottom wall 334 positioned adjacent to the lower end convolution 324, and a side wall 336 that extends between the top wall 332 and the bottom wall 334. Thus, the pocketed spring 310 has a construction similar to the pocketed spring 10 described above with reference to FIGS. 1A-D.

Figure 4:
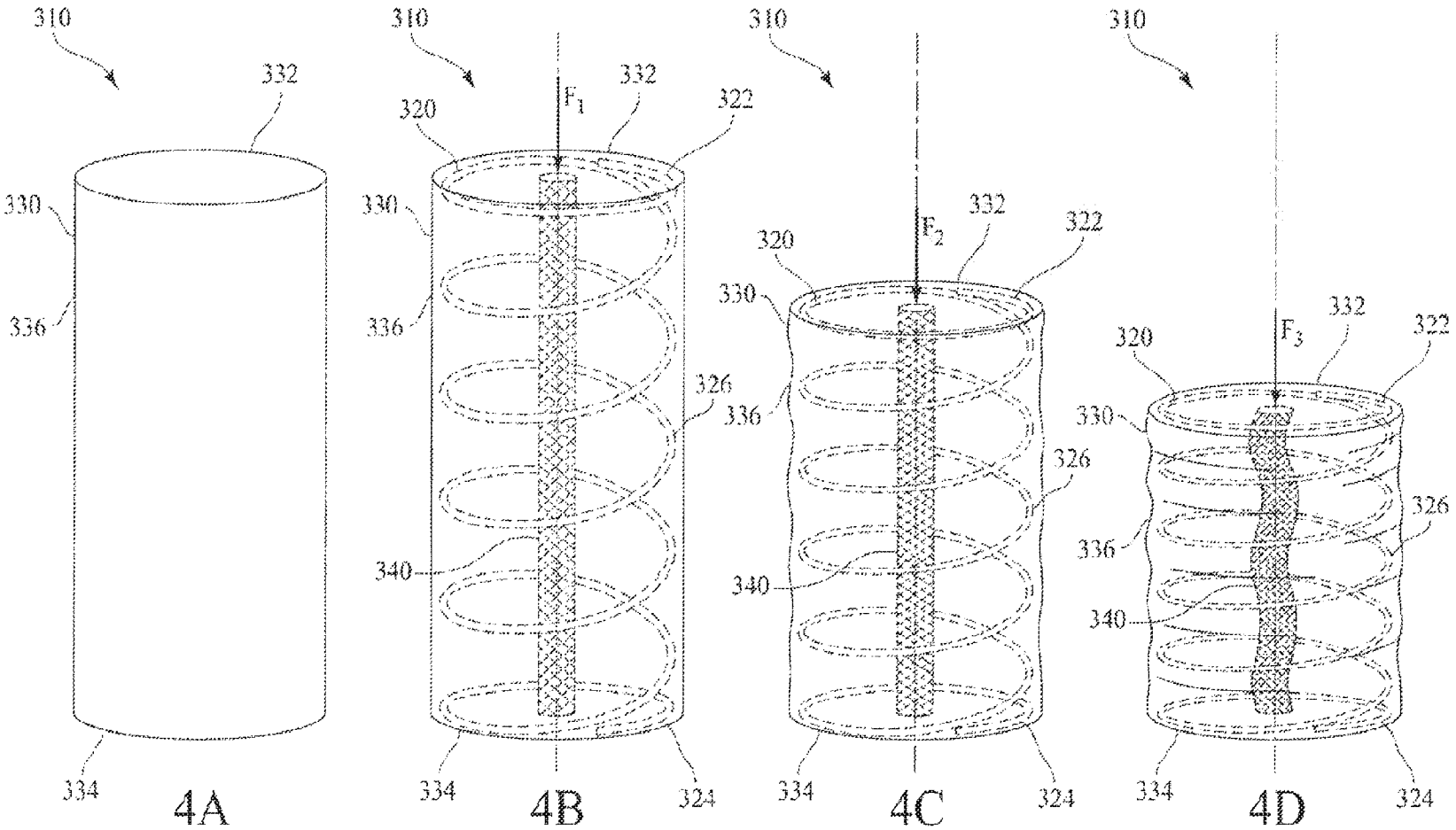
FIG. 4A is a perspective view of another exemplary pocketed spring, made in accordance with the present invention.
FIG. 4B is a perspective view of the exemplary pocketed spring of FIG. 4A, with a first predetermined force, $F_1$, applied to the pocketed spring.
FIG. 4C is a perspective view of the exemplary pocketed spring of FIG. 4A, with a second predetermined force, $F_2$, applied to the pocketed spring, such that the pocketed spring is partially compressed.
FIG. 4D is a perspective view of the exemplary pocketed spring of FIG. 4A, with a third predetermined force, $F_3$, applied to the pocketed spring, such that the pocketed spring is further compressed.

The pocketed spring 310 also includes a tension member in the form of an elastic cable 340 that is connected to the top wall 332 of the flexible enclosure 330 and the bottom wall 334 of the flexible enclosure 330, such that the elastic cable 340 extends through the interior of the flexible enclosure 330 along a central longitudinal axis of the compression spring 320. As shown in FIG. 4C, as the pocketed spring 310 is compressed, the side wall 336 of the flexible enclosure 330 immediately begins to hang loosely around the compression spring 320 as the elastic cable 340 does not provide a tensile force to the side wall 336 of the flexible enclosure 330 to keep the side wall 336 taut. As shown in FIG. 4D, the elastic cable 340 is configured such that it will enter a relaxed state prior to the compression spring 320 reaching a maximum compression.

With respect to the elastic cable 340, although not shown, it is contemplated that the elastic cable 340 could be comprised of one or more elastic strands aligned linearly or braided into a single cord. In some embodiments, the elastic cable 340 may further include a cover made of a woven textile which surrounds a core of elastic strands.

Regardless of the particular configuration of the elastic cable 340, the pocketed spring 310 also exhibits a non-linear response to force loading similar to the pocketed spring 10 described above with reference to FIGS. 1A-D and 6. Specifically, in a first response state, both the compression spring 320 and the elastic cable 340 are engaged, and the spring constant of the pocketed spring 310 is the spring constant of the compression spring 320 less the spring constant of the elastic cable 340. In a second response state, only the compression spring 320 is engaged, and the spring constant of the pocketed spring 310 is the spring constant of the compression spring 320.

Referring now to FIGS. 5A-D, in another exemplary embodiment of the present invention, a pocketed spring 410 is provided that also includes: (i) a compression spring 420 made of a continuous wire and having an upper end convolution 422, a lower end convolution 424 opposite the upper end convolution 422, and a plurality of intermediate convolutions 426 between the upper end convolution 422 and the lower end convolution 424; and (ii) a flexible enclosure 430 that includes a top wall 432 positioned adjacent to the upper end convolution 422 of the compression spring 420, a bottom wall 434 positioned adjacent to the lower end convolution 424, and a side wall 436 that extends between the top wall 432 and the bottom wall 434. Thus, the pocketed spring 410 has a construction that is substantially identical to the pocketed spring 310 described above with reference to FIGS. 4A-D.

However, as an alternative to a tension member in the form of an elastic cable 340 described above with reference to FIGS. 4A-D, in this exemplary embodiment, the pocketed spring 410 includes a tension member in the form of an inner spring 440 that is connected to the top wall 432 of the flexible enclosure 430 and the bottom wall 434 of the flexible enclosure 430, such that the inner spring 440 extends through the interior of the flexible enclosure 430 along a central longitudinal axis of the compression spring 420.

Figure 5:
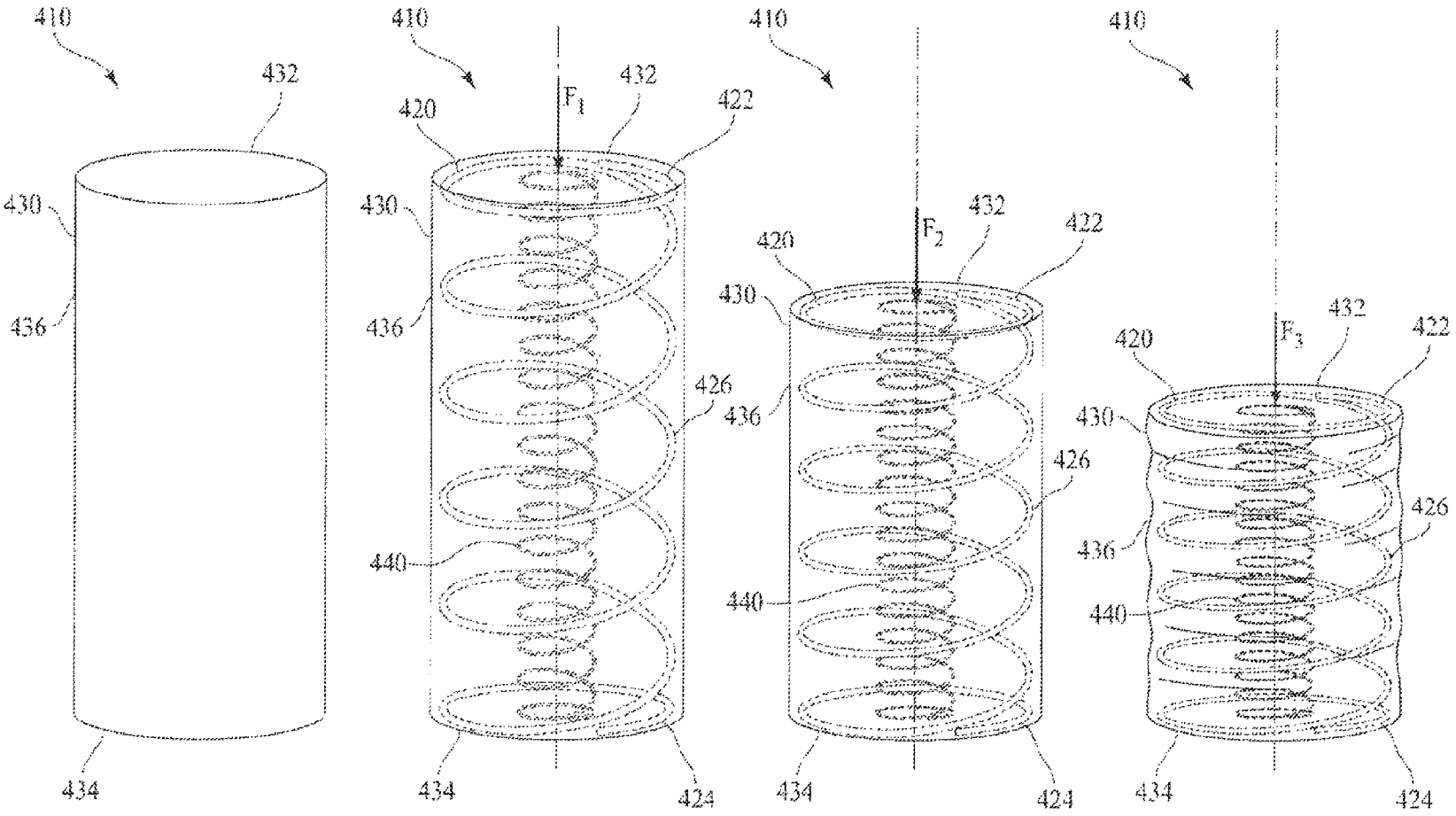
FIG. 5A is a perspective view of another exemplary pocketed spring made in accordance with the present invention.
FIG. 5B is a perspective view of the exemplary pocketed spring of FIG. 5A, with a first predetermined force, $F_1$, applied to the pocketed spring.
FIG. 5C is a perspective view of the exemplary pocketed spring of FIG. 5A, with a second predetermined force, $F_2$, applied to the pocketed spring, such that the pocketed spring is partially compressed.
FIG. 5D is a perspective view of the exemplary pocketed spring of FIG. 5A, with a third predetermined force, $F_3$, applied to the pocketed spring, such that the pocketed spring is further compressed.

When the compression spring 420 is placed into the flexible enclosure 430 (as shown in FIG. 5A), the inner spring 440 is in a stretched state and exerts a tensile force that acts in opposition to the compressive force of the compression spring 420. When a first force, $F_1$, and a second predetermined force, $F_2$, are applied to the pocketed spring 410 (as shown in FIGS. 5B-C), the pocketed spring 410 then becomes partially compressed, with the inner spring 440 being partially relaxed, but still continues to exert a tensile force that acts in opposition to the compressive force of the compression spring 420. Subsequently, when a third force, $F_3$, that exceeds the second predetermined force, $F_2$, is applied to the pocketed spring 410 (as shown in FIG. 5D), the pocketed spring 410 compresses further, and the inner spring 440 fully relaxes and transitions into a compressive state where the inner spring 440 exerts a compressive force that acts in addition to the compressive force of the compression spring 420.

Accordingly, the pocketed spring 410 also exhibits a nonlinear response to force loading similar to the pocketed spring 10 described above with reference to FIGS. 1A-D and 6. Specifically, in a first response state, both the compression spring 420 and the inner spring 440 are engaged, and the spring constant of the pocketed spring 410 is the spring constant of the compression spring 420 less the spring constant of the inner spring 440. However, unlike the pocketed spring 10 described above with reference to FIGS. 1A-D and 6, in a second response state, both the compression spring 420 and the inner spring 440 are under compression, and the spring constant of the pocketed spring 410 is the spring constant of the compression spring 420 plus the spring constant of the inner spring 440.

It is also contemplated that, in some embodiments, the inner spring 440 would be configured to buckle rather than transitioning into a compressive state. In such embodiments, the inner spring 440 would not exert any appreciable compressive force, and so, in the second (i.e., compressive) response state, only the compression spring 420 is engaged, and the spring constant of the pocketed spring 410 would be the spring constant of the compression spring 420.

Referring now to FIGS. 7A-D, in another exemplary embodiment of the present invention, a pocketed spring 510 is provided that includes a coil-in-coil spring 520 having an outside coil 521 and an inside coil 527 that are coaxial, helical-formed coils made of a continuous wire. As shown, the outside coil 521 begins with a flat base 524 that continues upward in a spiral section. An upper end convolution 522 of the outside coil 521 ends in a circular loop at the extreme end of the coil-in-coil spring 520. The base 524 is formed with a double circular loop, with the inside loop extending upward in a spiral to form the inside coil 527. The outside coil 521 is larger in height than the inside coil 527. Also, in this exemplary embodiment, the diameter of the outside coil 521 is larger than the diameter of the inside coil 527, which ensures there is no interference between the outside coil 521 and the inside coil 527. The body of the outside coil 521 contains six convolutions, or turns, whereas the body of the inside coil 527 contains seven convolutions. Of course, alternate embodiments of the coil may be constructed with different configurations, such as different numbers of convolutions or turns, and different shapes to the end coils. For an example of another exemplary coil-in-coil spring which may be used in the present invention, reference is made to U.S. Pat. No. 7,908,693, which is herein incorporated by reference.

In some embodiments, the spring constant of the inside coil 527 is greater than the spring constant of the outside coil 521. The coil-in-coil design provides two different spring constants during compression of the pocketed spring 510 when used in, for example, a mattress. During initial loading, only the outside coil 521 is compressed, whereas under a heavy or concentrated load, both the outside coil 521 and the inside coil 527 work to support the load. This allows for a comfortable compression under a light load, such as when a mattress is used for sleeping, wherein the load is distributed over a relatively large surface area. At the same time, the coil-in-coil design can effectively support a heavy load concentrated in one location, such as when one is seated on the mattress. The upper portion or outside coil 521 is flexible enough to provide a resilient and comfortable seating or sleeping surface, and the lower portion is strong enough to absorb abnormal stresses, weight concentrations, or shocks without discomfort or damage. The relative spring constants also provide a gradual transition between the outside coil 521 and combined coils 521, 527 upon compression, so that the shift from compression of the outside coil 521 only to the compression of both the outside and inside coils 521, 527 as the load increases is not felt by one seated on the mattress.

Referring still to FIGS. 7A-D, the exemplary pocketed spring 510 further includes: (i) a flexible enclosure 530 that includes a top wall 532 positioned adjacent to the upper end convolution 522 of the outside coil 521 of the coil-in-coil spring 520, a bottom wall 534 positioned adjacent to the base 524 of the coil-in-coil spring 520, and a side wall 536 that extends between the top wall 532 and the bottom wall 534; and (ii) a tension member 540 made of an elastomer and in the form of a cylindrical band that is laminated to a portion of the side wall 536 of the flexible enclosure 530 in a substantially identical manner to the tension member 40 described above with reference to FIGS. 1A-D. Accordingly, the flexible enclosure 530 and the tension member 540 of the pocketed spring 510 of this exemplary embodiment function in the same way as the flexible enclosure 30 and the tension member 40 of the pocketed spring 10 described above with reference to FIGS. 1A-D. However, the inclusion of the coil-in-coil spring 520 in this exemplary pocketed spring 510, as opposed to the single compression spring 20, provides an additional means of altering the spring constant of the pocketed spring 510 at a specified compressive distance in order to exhibit a non-linear response to loading and develop a preferred compression response of the pocketed spring 510, as described in further detail below.

Figure 7:
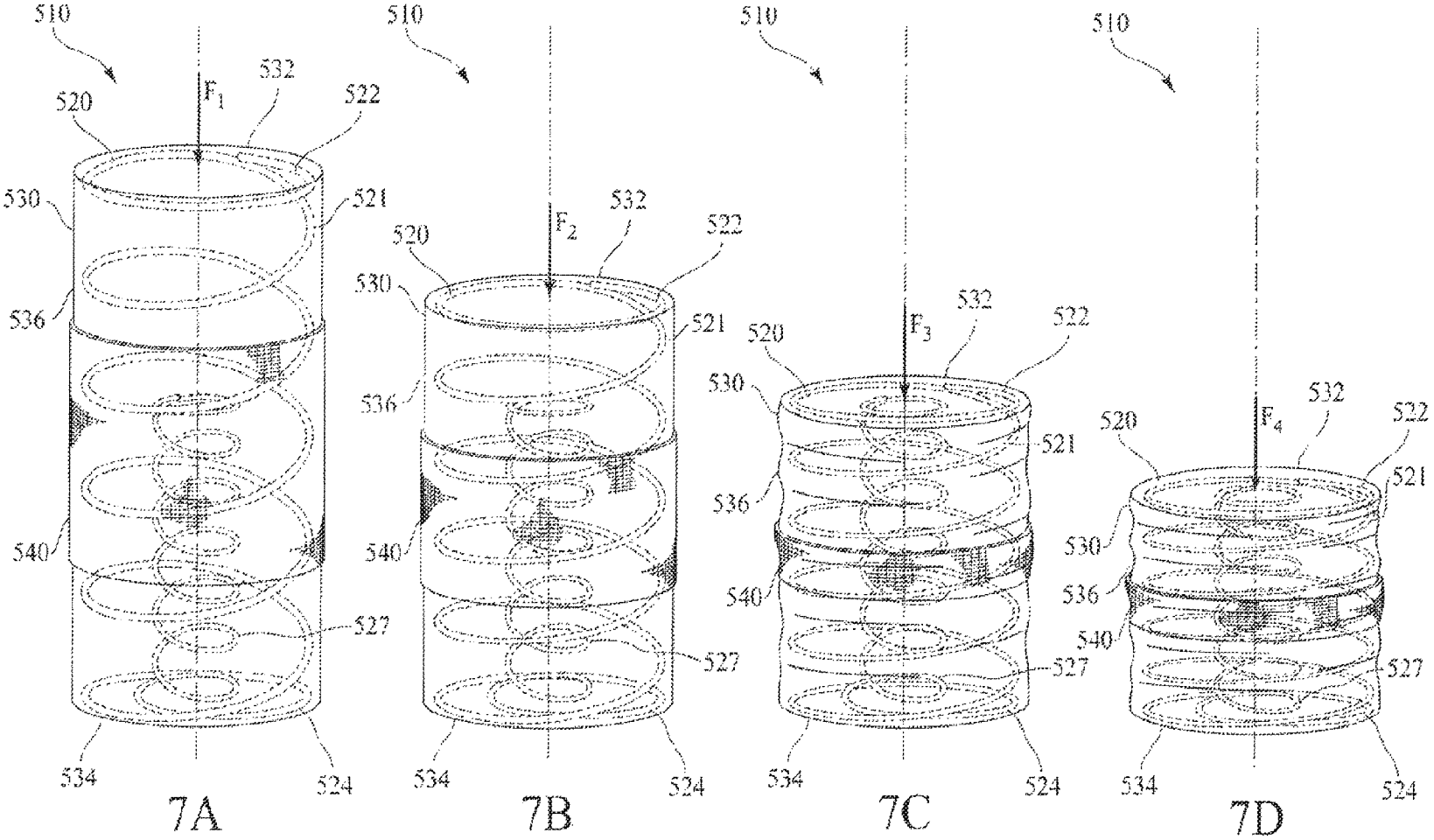
FIG. 7A is a perspective view of another exemplary pocketed spring made in accordance with the present invention, with a predetermined force, $F_1$, applied to the pocketed spring.
FIG. 7B is a perspective view of the exemplary pocketed spring of FIG. 7A, with a second predetermined force, $F_2$, applied to the pocketed spring, such that the pocketed spring is partially compressed.
FIG. 7C is a perspective view of the exemplary pocketed spring of FIG. 7A, with a third predetermined force, $F_3$, applied to the pocketed spring, such that an inside coil of the pocketed spring is engaged, but not yet compressed.
FIG. 7D is a perspective view of the exemplary pocketed spring of FIG. 7A, with a fourth predetermined force, $F_4$, applied to the pocketed spring, such that the inside coil of the pocketed spring is partially compressed.
Figure 8:
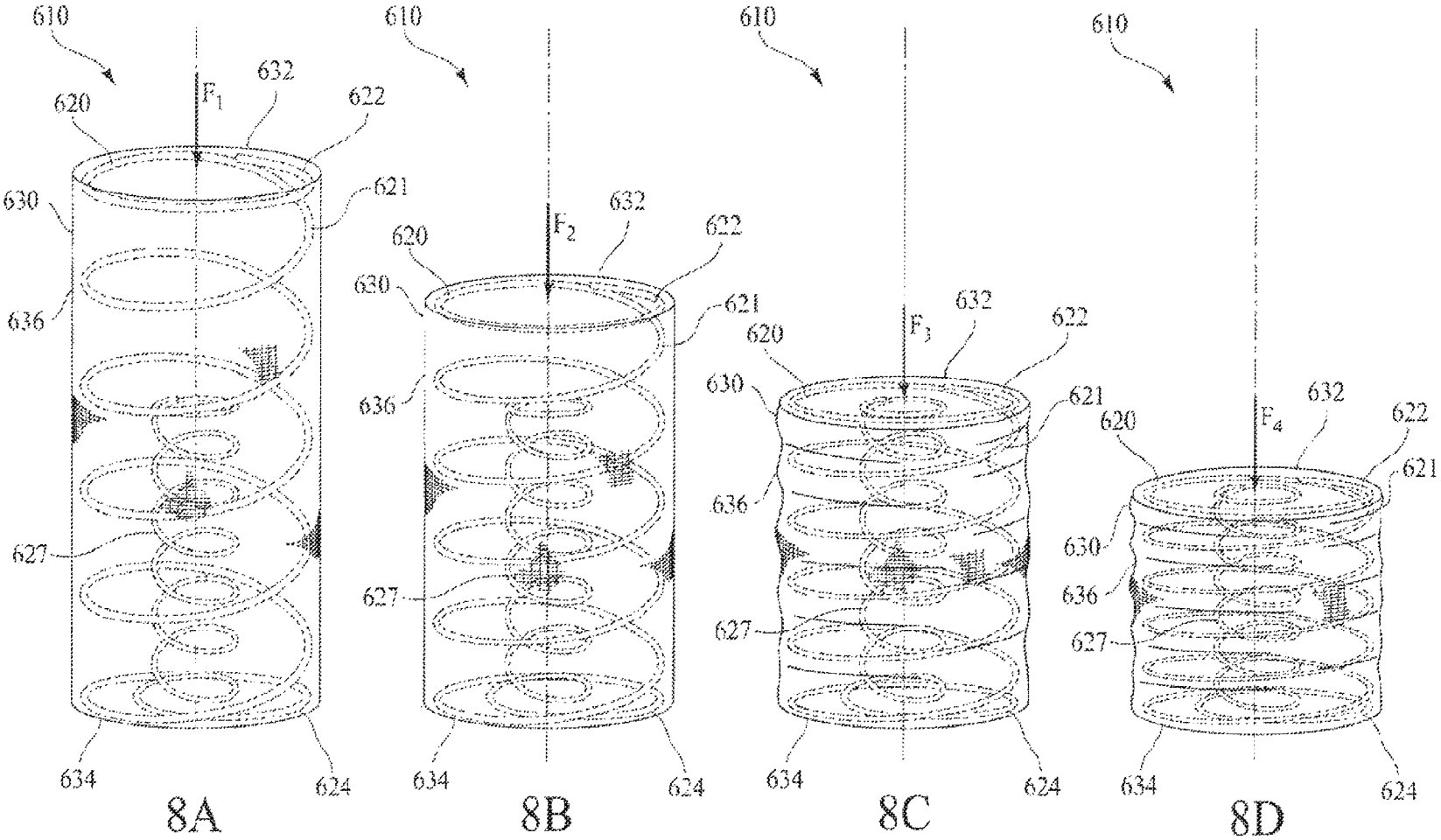
FIG. 8A is a perspective view of another exemplary pocketed spring made in accordance with the present invention, with a predetermined force, $F_1$, applied to the pocketed spring.
FIG. 8B is a perspective view of the exemplary pocketed spring of FIG. 8A, with a second predetermined force, $F_2$, applied to the pocketed spring, such that the pocketed spring is partially compressed.
FIG. 8C is a perspective view of the exemplary pocketed spring of FIG. 8A, with a third predetermined force, $F_3$, applied to the pocketed spring, such that an inside coil of the pocketed spring is engaged, but not yet compressed.
FIG. 8D is a perspective view of the exemplary pocketed spring of FIG. 8A, with a fourth predetermined force, $F_4$, applied to the pocketed spring, such that the inside coil of the pocketed spring is partially compressed.

Referring now to FIG. 7A, when the coil-in-coil spring 520 is "pocketed" or placed into the flexible enclosure 530, the outside coil 521 of the coil-in-coil spring 520 is held in a pre-compressed state by the flexible enclosure 530, while the tension member 540 is in a stretched state. With the coil-in-coil spring 520 pre-compressed within the flexible enclosure 530, when a first predetermined force, $F_1$, is applied to the pocketed spring 510 that is equal to the force required to compress the coil-in-coil spring 520 into the flexible enclosure 530 as the coil-in-coil spring 520 is under tension by the tension member 540, the pocketed spring 510 is not compressed. At that point, the coil-in-coil spring 520 (i.e., the outside coil 521 of the coil-in-coil spring 520) acts against both the first predetermined force, $F_1$, as well as a tensile force of the tension member 540, and any additional force applied to the pocketed spring 510 beyond that first predetermined force, $F_1$, will result in the pocketed spring 510 compressing.

Referring now to FIG. 7B, when a second predetermined force, $F_2$, is applied to the pocketed spring 510 that exceeds the first predetermined force, $F_1$, the pocketed spring 510 then begins to partially compress. In particular, upon application of the second force, $F_2$, the outside coil 521 of the coil-in-coil spring 520 is compressed beyond its pre-compressed state; however, the inside coil 527 is not yet engaged. Furthermore, the tension member 540 has partially relaxed; however, the tension member 540 is still in a partially stretched state. Accordingly, the tension member 540 still provides a tensile force on the outside coil 521 of the coil-in-coil spring 520, as well as to the side wall 536 of the flexible enclosure 530 keeping the side wall 536 substantially taut.

Referring now to FIG. 7C, when a third predetermined force, $F_3$, is applied to the pocketed spring 510 that exceeds the second predetermined force, $F_2$, the pocketed spring 510 compresses to a point where the inside coil 527 of the coil-in-coil spring 520 is engaged, but has not yet itself been compressed. As shown in FIG. 7C, prior to the inside coil 527 compressing, the tension member 540 has entered a relaxed state, such that both the tension member 540 and the flexible enclosure 530 hang loosely around the coil-in-coil spring 520. Accordingly, in FIG. 7C, the tension member 540 is no longer applying a tensile force to the outside coil 521 of the coil-in-coil spring 520, and only the outside coil 521 of the coil-in-coil spring 520 is acting against the third predetermined force, $F_3$.

Referring now to FIG. 7D, when a fourth predetermined force, $F_4$, is applied to the pocketed spring 510 that exceeds the third predetermined force, $F_3$, the pocketed spring 510 is now compressed to a point where the inside coil 527 of the coil-in-coil spring 520 is also compressed. The tension member 540 is still in the relaxed state and so provides no tensile force. Accordingly, both the outside and the inside coils 521, 527 of the coil-in-coil springs are acting against the fourth predetermined force, $F_4$.

By assembling the pocketed spring 510 in such a manner, the pocketed spring 510 also exhibits a non-linear response to force loading. In particular, the pocketed spring 510 exhibits three different response states, as compared to the two response states of the exemplary pocketed springs 10, 110, 210, 310, 410 described above. In the first response state, and as shown in FIG. 7B, the outside coil 521 of the coil-in-coil spring 520 and the tension member 540 are engaged, and the spring constant of the pocketed spring 510 is the spring constant of the outside coil 521 of the coil-in-coil spring 520 less the spring constant of the tension member 540. In the second response state, as additional force is applied and as shown in FIG. 7C, the tension member 540 is in a relaxed state, and only the outside coil 521 of the coil-in-coil spring 520 is engaged (because the inside coil 527 has not yet compressed). Accordingly, the spring constant of the pocketed spring 510 in the second response state is the spring constant of the outside coil 521 of the coil-in-coil spring 520. In the third response state shown in FIG. 7D, however, both the outside and inside coils 521, 527 of the coil-in-coil spring 520 are engaged, and the spring constant of the pocketed spring 510 is the spring constant of the outside coil 521 plus the spring constant of the inside coil 527 of the coil-in-coil spring 520.

Referring now to FIGS. 8A-D, in another exemplary embodiment of the present invention, a pocketed spring 610 is provided that also includes a coil-in-coil spring 620 having an outside coil 621 and an inside coil 627 that are coaxial, helical formed springs made of a continuous wire. As shown, the outside coil 621 begins with a flat base 624 that continues upward in a spiral section. An upper end convolution 622 of the outside coil 621 ends in a circular loop at the extreme end of the coil-in-coil spring 620. The base 624 is formed with a double circular loop, with the inside loop extending upward in a spiral to form the inside coil 627. Furthermore, the pocketed spring 610 includes a flexible enclosure 630 that includes a top wall 632 positioned adjacent to the upper end convolution 622 of the outside coil 621 of the coil-in-coil spring 620, a bottom wall 634 positioned adjacent to the base 624, and a side wall 636 that extends between the top wall 632 and the bottom wall 634.

In this exemplary embodiment, like the pocketed spring 110 described above with reference to FIGS. 2A-D, the side wall 636 of the flexible enclosure 630 is made entirely of an elastic fabric such that the flexible enclosure 360 itself serves as a tension member. In this way, this exemplary pocketed spring 610 provides both the benefits of having a coil-in-coil spring 620, as well as having a flexible enclosure 630 comprised entirely of an elastic material.

Referring now to FIGS. 9A-D, in another exemplary embodiment of the present invention, a pocketed spring 710 is provided that also includes a coil-in-coil spring 720 having an outside coil 721 and an inside coil 727 that are coaxial, helical formed springs made of a continuous wire. As shown, the outside coil 721 begins with a flat base 724 that continues upward in a spiral section. An upper end convolution 722 of the outside coil 721 ends in a circular loop at the extreme end of the coil-in-coil spring 720. The base 724 is formed with a double circular loop, with the inside loop extending upward in a spiral to form the inside coil 727. Furthermore, the pocketed spring 710 includes a flexible enclosure 730 that includes a top wall 732 positioned adjacent to the upper end convolution 722 of the outside coil 721 of the coil-in-coil spring 720, a bottom wall 734 positioned adjacent to the base 724, and a side wall 736 that extends between the top wall 732 and the bottom wall 734.

Figure 9:
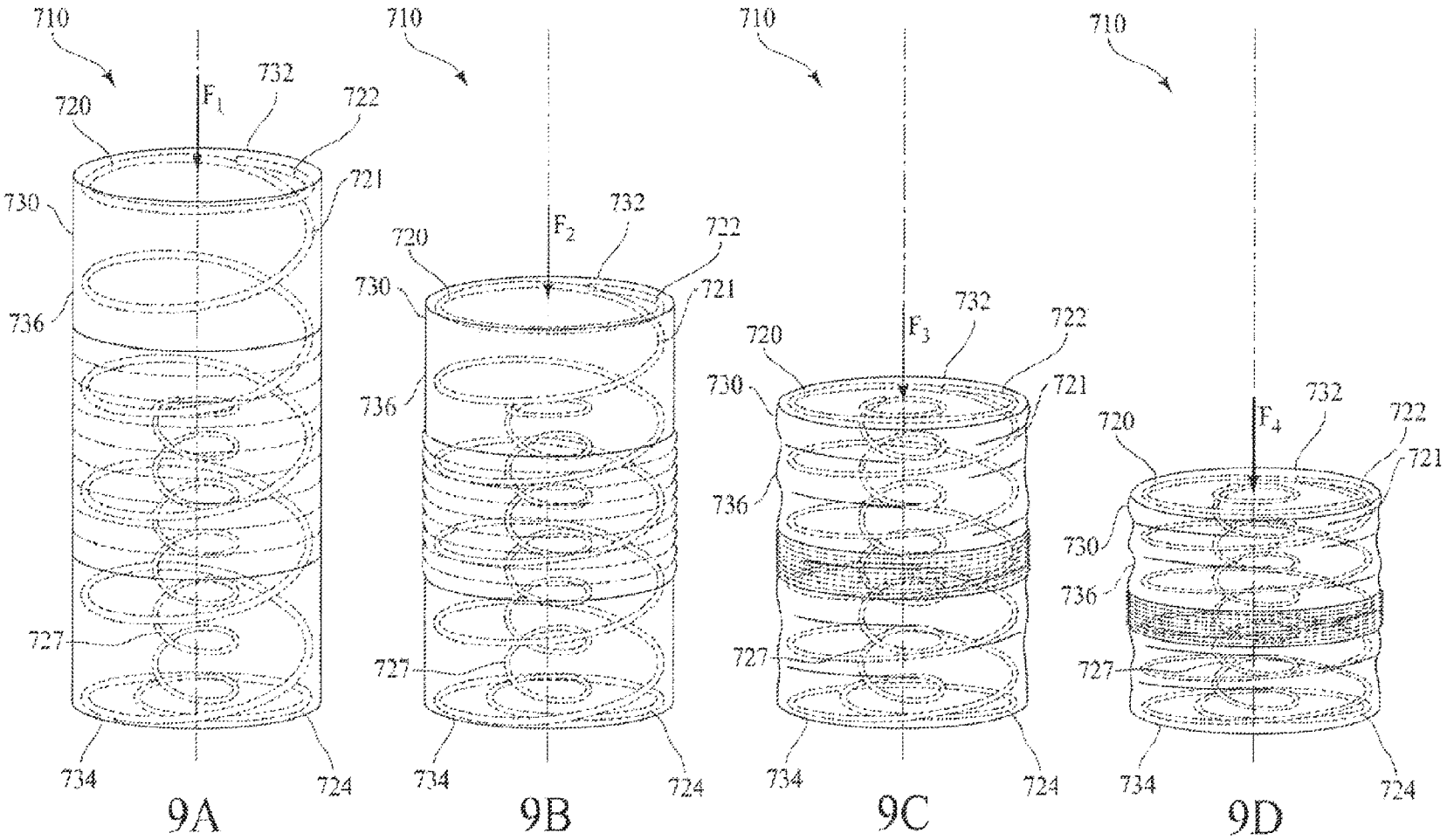
FIG. 9A is a perspective view of another exemplary pocketed spring made in accordance with the present invention, with a predetermined force, $F_1$, applied to the pocketed spring.
FIG. 9B is a perspective view of the exemplary pocketed spring of FIG. 9A, with a second predetermined force, $F_2$, applied to the pocketed spring, such that the pocketed spring is partially compressed.
FIG. 9C is a perspective view of the exemplary pocketed spring of FIG. 9A, with a third predetermined force, $F_3$, applied to the pocketed spring, such that an inside coil of the pocketed spring is engaged, but not yet compressed.
FIG. 9D is a perspective view of the exemplary pocketed spring of FIG. 9A, with a fourth predetermined force, $F_4$, applied to the pocketed spring, such that the inside coil of the pocketed spring is partially compressed.

In this exemplary embodiment, like the pocketed spring 210 described above with reference to FIGS. 3A-3D, the pocketed spring 710 also includes a tension member (not shown) that is made of an elastomer and is laminated to an interior surface of a mid-section of the side wall 736 of the flexible enclosure 730. At the same time, however, the entire flexible enclosure 730 is made of an inelastic material. In order to allow the tension member to reach the stretched state shown in FIG. 9A, the tension member is in a pre-tensioned state when it is laminated to the side wall 736 of the flexible enclosure 730. As shown in FIGS. 9C and 9D, as the pocketed spring 710 compresses and the tension member partially relaxes, the underlying inelastic material of the side wall 736 of the flexible enclosure 730 begins to bunch or crimp. In this way, this exemplary pocketed spring 710 provides both the benefits of having a coil-in-coil spring 720, as well as having a flexible enclosure 730 comprised entirely of an inelastic material, but having a tension member laminated to an interior surface of the flexible enclosure 730.

Figure 10:
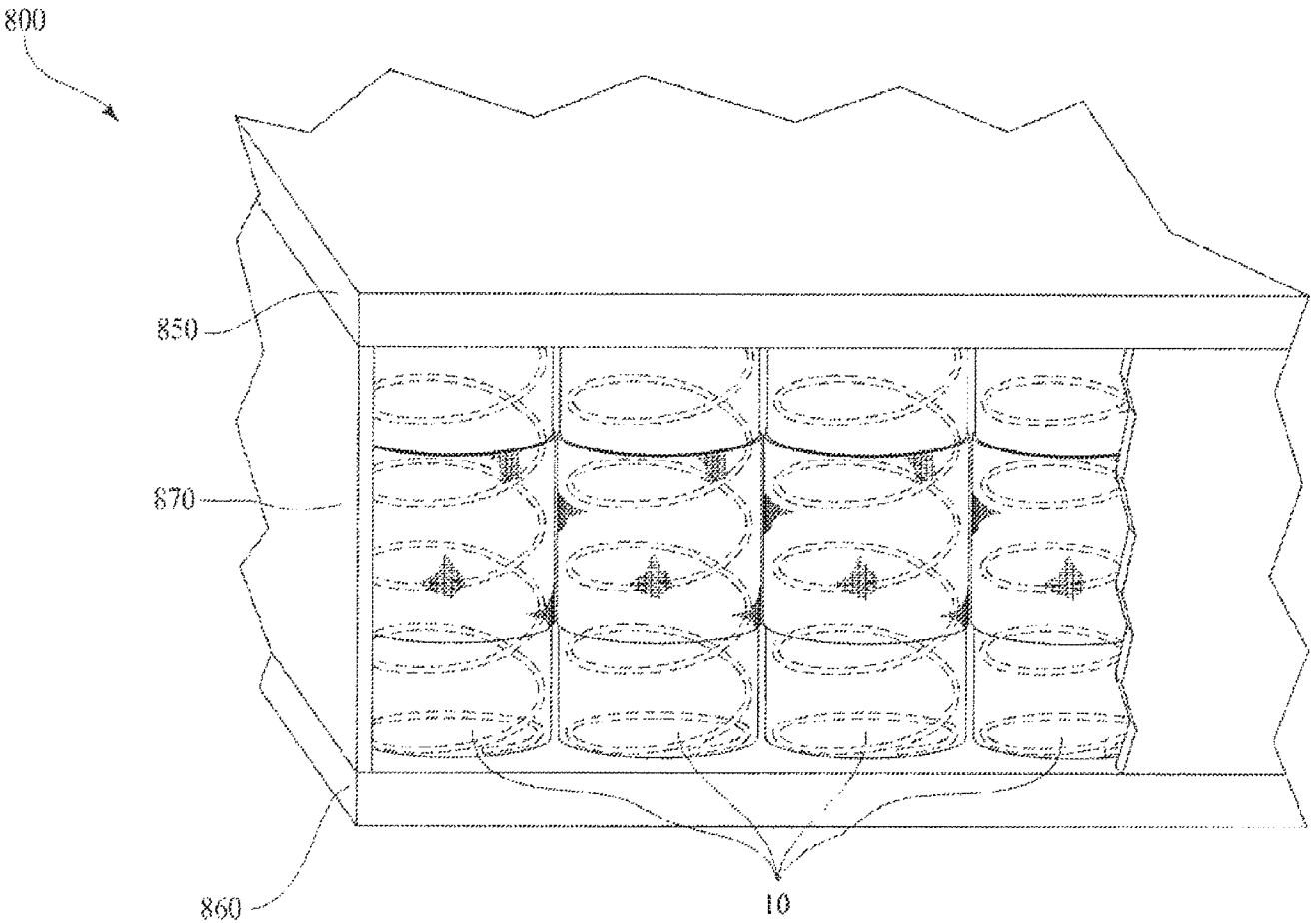
FIG. 10 is a partial perspective view of a mattress incorporating the exemplary pocketed springs of FIG. 1 with a portion of the mattress assembly removed to show a plurality of the pocketed springs.

Referring now to FIG. 10, an exemplary mattress 800 made in accordance with the present invention includes a plurality of the pocketed springs 10 described above with reference to FIGS. 1A-D. The pocketed springs 10 are arranged in a matrix, such that the top walls of the flexible enclosures of the pocketed springs 10 collectively define a first support surface (or sleep surface), and the bottom walls of the flexible enclosures of the pocketed springs 10 defines a second support surface opposite the first support surface. Typically, each pocketed spring 10 is arranged in a succession of strings, after which each such strings are connected to each other side by side to form a matrix. The interconnection of strings can take place by welding or gluing. Such interconnection, however, can alternatively be carried out by means of clamps or hook-and-loop fasteners, or in some other convenient manner. The mattress 800 also comprises an upper body supporting layer 850 positioned adjacent to the first support surface, along with a lower foundation layer 860 positioned adjacent to the second support surface. Furthermore, a side panel 870 extends between the upper body supporting layer 850 and the lower foundation layer 860 around the entire periphery of the two layers 850, 860, such that the pocketed springs 10 are completely surrounded.

It is contemplated that the upper body supporting layer 850 is comprised of some combination of foam, upholstery, and/or other soft, flexible materials well known in the art. Furthermore, the upper body supporting layer 850 may be comprised of multiple layers of material configured to improve the comfort or support of the upper body supporting layer 850.

It is also contemplated that the lower foundation layer 860 could be similarly comprised of some combination of foam, upholstery, and/or other soft flexible material well known in the art, such that the mattress 800 can function no matter which way it is oriented. However, in other embodiments, the lower foundation layer 860 is comprised of a rigid member configured to support the plurality of pocketed springs 10.

Throughout this document, various references are mentioned. All such references are incorporated herein by reference.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A mattress comprising:

a plurality of pocketed springs arranged in a matrix and defining a first support surface and a second support surface opposite the first support surface, with each of the plurality of pocketed springs including (a) a compression spring having an upper end convolution and a lower end convolution opposite the upper end convolution, and a plurality of helical intermediate convolutions between the upper end convolution and the lower end convolution, (b) a flexible enclosure including a fabric top wall positioned adjacent to the upper end convolution of the compression spring, a fabric bottom wall positioned adjacent to the lower end convolution of the compression spring, and a side wall that extends continuously from the fabric top wall to the fabric bottom wall, and (c) a tension member connected to the flexible enclosure, said tension member acting opposite to the compression spring and being connected to the fabric top wall and the fabric bottom wall;

an upper body supporting layer positioned adjacent to the first support surface;

a lower foundation layer positioned adjacent to the second support surface; and a side panel extending between the upper body supporting layer and the lower foundation layer.

2. The mattress of claim 1, wherein the tension member of each of said plurality of pocketed springs is made of an elastomer.

3. The mattress of claim 2, wherein the elastomer is laminated to substantially all of the side wall of the flexible enclosure of each of said plurality of pocketed springs.

4. The mattress of claim 2, wherein the elastomer is comprised of latex or neoprene.

* * * * *